United States Patent [19]

Gerch

[11] Patent Number: 4,860,563

[45] Date of Patent: Aug. 29, 1989

[54] KEYHOLDER FOR LUGGAGE

[75] Inventor: Edward L. Gerch, Chicago, Ill.

[73] Assignee: Kingport International Corporation, Evanston, Ill.

[21] Appl. No.: 232,080

[22] Filed: Aug. 15, 1988

[51] Int. Cl.[4] ..... A44B 15/00

[52] U.S. Cl. ..... 70/456 R; 190/102; 150/106

[58] Field of Search ..... 70/456 R–459; 150/106, 112, 113; 190/102

[56] References Cited

U.S. PATENT DOCUMENTS

| | | | |
|---|---|---|---|
| 533,373 | 1/1895 | Presby | 70/456 R |
| 550,172 | 11/1895 | Hensley | 70/456 R X |
| 1,627,224 | 5/1927 | Asherman | 150/106 |
| 2,117,989 | 5/1938 | Ryan | 70/456 R |
| 2,224,972 | 12/1940 | Long, Jr. et al. | 70/457 X |
| 2,407,153 | 9/1946 | Hanna | 70/459 X |
| 2,781,113 | 2/1957 | Seeman | 190/102 |
| 3,263,464 | 8/1966 | Campbell | 70/456 R |
| 3,318,354 | 5/1967 | Borisof | 70/457 X |
| 3,326,258 | 6/1967 | Stucker | 70/456 R X |
| 3,406,546 | 10/1968 | Clement | 70/456 R |
| 3,415,300 | 12/1968 | Worcester | 70/456 R |
| 3,620,057 | 11/1971 | Holland | 70/456 R |
| 3,682,216 | 8/1972 | Nelson | 150/106 |
| 4,004,325 | 1/1977 | Hubachek | 150/106 X |
| 4,072,033 | 2/1978 | Eckerdt | 70/459 X |
| 4,166,489 | 9/1979 | Lemelson | 70/456 R X |
| 4,226,350 | 10/1980 | Detje | 70/459 X |
| 4,532,972 | 8/1985 | Sinsko | 150/106 X |

FOREIGN PATENT DOCUMENTS

| | | | |
|---|---|---|---|
| 732949 | 4/1966 | Canada | 70/456 R |
| 719821 | 2/1932 | France | 70/457 |
| 1491424 | 7/1967 | France | 70/459 |
| 186807 | 12/1936 | Switzerland | 70/459 |

*Primary Examiner*—Gary L. Smith
*Assistant Examiner*—Suzanne L. Dino

[57] ABSTRACT

Luggage, such as hand carried briefcases, purses or the like, are provided with key ring holders on an inner face thereof, preferably a cover. The holder is in the form of a short horizontal or longitudinal strap secured at its midsection to the face just above an open top of a conventional pocket or envelope mounted on the inner face. The strap has wings or legs projecting from its secured mid portion. The end of each wing or leg has a pad of a hook and loop ("Velcro") fastener secured on its inner side. A complimentary hook and loop pad is secured to the opposing inner face of the cover at a location to secure the outer ends of the wings or legs in an extended flat condition against the cover. The two wings or legs are pulled free of the cover carried pads, and are brought together on opposite sides of their secured mid portion. A key carrying key ring is draped over the juxtaposed wings which are then spread apart back to their original extended positions and pressed against the cover pads to trap the key ring on opposite sides of the secured central portion of the strap. The keys on the key ring are dropped into the mouth of the pocket or envelope to be held flatwise in an easily accessible position until needed.

11 Claims, 1 Drawing Sheet

KEYHOLDER FOR LUGGAGE

BACKGROUND OF THE INVENTION

1. Field of the Invention

This invention relates to the art of mounting keys in luggage and specifically deals with a simple strap arrangement on the inner face of a briefcase cover to detachably mount a key carrying key ring flatwise against the cover with the depending keys projecting into the mouth of an underlying flap or pocket on the cover.

2. Description of the Prior Art

Heretofore, key carrying key rings have been deposited in purses, briefcases, and the like luggage where they are soon well hidden by the contents of the luggage and are most difficult to locate when needed. Even when the key rings are placed in a compartment, such as an open top pocket of the luggage, they will soon become comingled with the contents of the pocket to require a frustrating search problem when needed.

It would thus be an improvement in the luggage art to provide an inexpensive easily manipulated holder for keys in the interior of purses, briefcases, and the like luggage which keeps the keys in an easily accessible position apart from the contents of the luggage. It would be a specific further improvement in this art to removably mount a key carrying key ring in flat position against the inner face of an easily accessible portion of a purse or briefcase.

SUMMARY OF THE INVENTION

According to this invention a strap, preferably of the same material as the luggage or purse to which it is to be attached, is stitched or otherwise secured at its longitudinal center to the inner face of the sidewall of the luggage, preferably the lid or cover thereof, to provide two wings or legs extending horizontally or longitudinally of the luggage at a level just above a pocket or envelope carried by this inner face. This strap need only be about 3½ inches long and about ½ inch wide. It has free outer ends, each carrying on its inner face a pad of a hook and loop fastener commonly known in the art as a "Velcro" fastener. These pads can conveniently be cylindrical in form and the outer edges of the strap may be rounded to conform with the shape of the pads. The sidewall of the luggage to which the strap is attached also has complimentary hook and loop fastener pads secured thereto at positions for mating with and holding each strap carrying pad to secure the strap flatwise against the inner face of the luggage.

The ends of the strap are easily pulled free from their locked positions and are conveniently drawn together to thread through a key ring and then stretched apart to their locked positions to hold the key ring flatly against the luggage surface on opposite sides of the stitched central portion of the strap.

Since the strap is mounted just above the open mouth of a pocket, panel or flap carried by the luggage, the keys will conveniently drop into the mouth to also be held flatwise adjacent the luggage wall on which the strap is secured.

A very convenient and accessible keyholder for the interior of luggage holding the keys in fixed position apart from the contents of the luggage is thus provided.

DETAILED DESCRIPTION OF THE ILLUSTRATED PREFERRED EMBODIMENT

Figure 1:
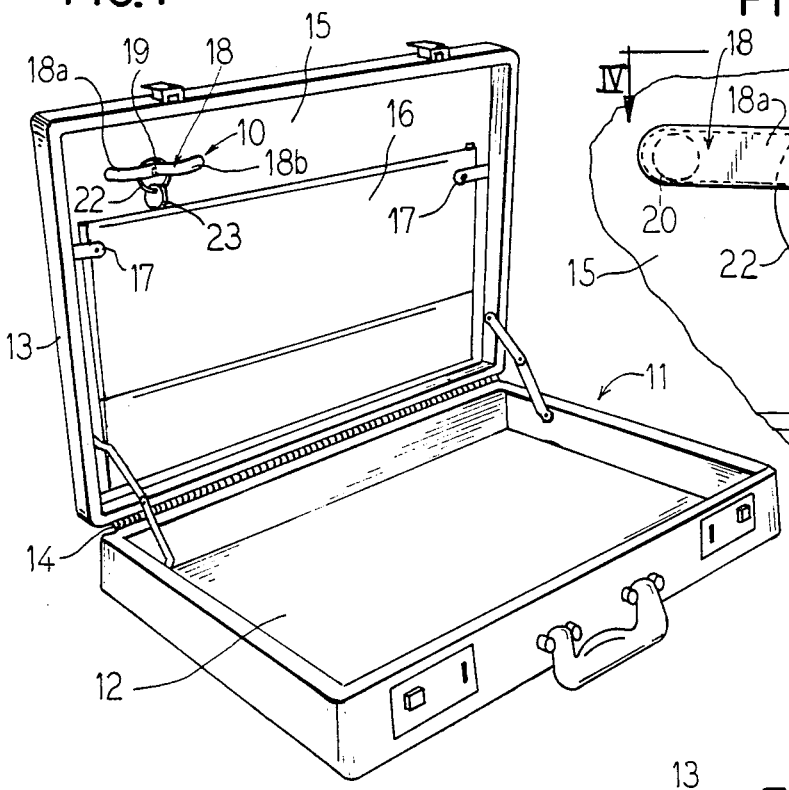
FIG. 1 is a perspective view of an opened briefcase equipped with a key ring holder of this invention.

The key ring holder 10 of this invention is illustrated in FIG. 1 as mounted in position in a conventional briefcase or attache case 11. As shown, the case 11 has an open top rectangular box-like body 12 closed by a lid or cover 13 which is hinged to the top back edge of the body at 14. The lid or cover 13 has a stiff or rigid flat inner face 15 carrying one or more open top pockets 16 held flatwise against the inner face 15 by releasable straps 17,17.

The case 11 is made of conventional luggage material such as leather, plastic or the like.

According to this invention the keyholder 10 is in the form of a strap 18, preferably of the same material as the case 11. It need only be about 3½ inches in length and about ½ inch wide. Its midsection is secured to the face 15 of the cover by stitching 19 or the like, thus providing opposite extending longitudinal wings **18*a* and 18*b* with free outer ends. These wings extend horizontally or longitudinally of the cover or lid 13 just above the mouth of the top flap or envelope 16 and preferably adjacent one side edge thereof. A spacing of 1 to 2 inches between the top edge of the envelope 16 and the bottom edge of the strap 18** is convenient.

The outer ends of the wings **18*a* and 18*b*** are preferably rounded as illustrated.

A pad 20 of a hook and loop fastener is secured to the inner or cover facing of each leg **18*a* and 18*b*** adjacent the rounded outer end thereof. These pads are preferably cylindrical to conform in shape with the rounded outer end edges of the wings.

Figure 5:
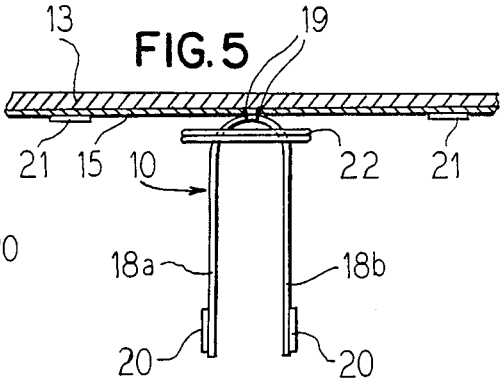
FIG. 5 is a plan view similar to FIG. 4 but showing the wings or legs of the holder pulled out in juxtaposition to receive the key ring.
Figure 4:
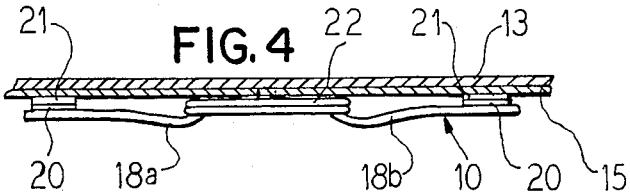
FIG. 4 is a sectional view with parts in plan, along the line IV—IV of FIG. 3.
Figure 6:
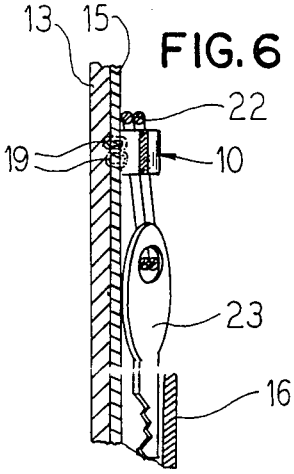
FIG. 6 is a transverse sectional view along the line VI—VI of FIG. 3.

As shown in FIGS. 4 and 5, pads 21 of hook and loop fasteners mating with the pads 20 are mounted on the inner face 15 of the cover 13 in positions to hold the strap 18 in its extended condition flatwise against the face 15 of the cover 13. In its unloaded condition, therefore, the strap 18 is held flat against the inner face 15 and will not present any obstacle to the interior of the case 11.

Figure 3:
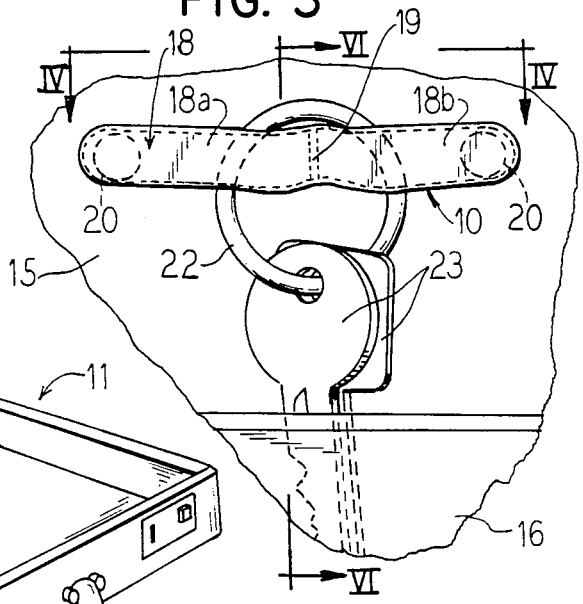
FIG. 3 is a view similar to FIG. 2 but showing a key ring carried by the holder with keys on the ring extended into the mouth of an underlying pocket on the briefcase cover.
Figure 2:
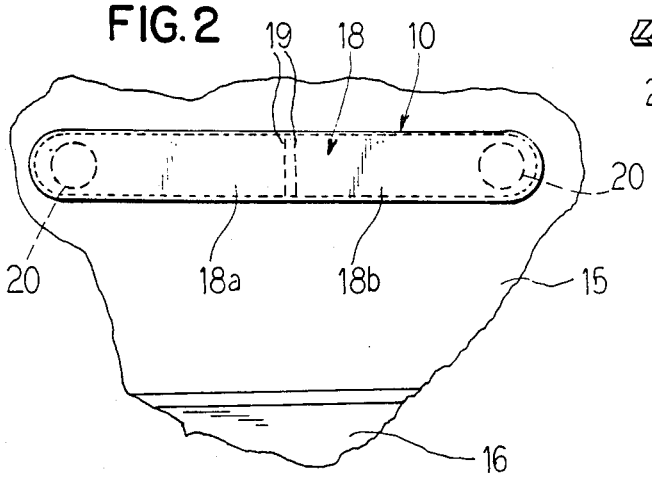
FIG. 2 is a fragmentary front elevational view of the keyholder portion of the briefcase cover showing the holder in an unloaded or empty condition.

A key ring 22 carrying a plurality of keys 23 is easily mounted in the holder 10 by pulling the free ends of the legs **18*a* and 18*b* free from the pads 21 and folding them together as illustrated in FIG. 5. The key ring is then draped over the juxtaposed legs 18*a* and 18*b* with the keys extending downwardly into the mouth of the pocket 16. Then, when the ends of the legs are spread apart and again attached to the pads 21 as shown in FIGS. 1 and 3, the key ring 22 will be held flatwise against the surface 15 on opposite sides of the stitched midsection 19 and the keys will drape themselves flatwise against the surface 15 into the mouth of the pocket 16**.

It will be understood, of course, that the confronting pads 20 and 21 are of opposite mating configurations with one pad containing loops and the other containing hooks to latch onto the loops.

The key ring, of course, is easily removed from the holder by pulling the legs 18*a* and 18*b* free from their locking pads 21.

The above descriptions and illustrations clearly show the details of a preferred embodiment of this invention but it should be understood that these details may be modified without departing from the scope of the invention as defined in the claims.

I claim as my invention:

1. In combination with luggage having an interior adapted to be opened and closed and an inner face which is accessible when the luggage is opened, a keyholder which comprises a strap secured to said inner face of the luggage at its longitudinal midsection having wings extending in opposite directions from the secured midsection, fasteners on the outer ends of the wings, cooperating fasteners on said inner face of the luggage holding the wings flatwise against the inner face, said wings adapted to be pulled free from the fasteners on said inner face and folded together on opposite sides of the midsection for insertion through a key ring and said fasteners adapted to be reattached to hold the key ring flatwise against the inner face of the luggage with any keys depending flatwise therefrom in the interior of the luggage.

2. The keyholder of claim 1 wherein the strap is about $3\frac{1}{2}$ inches long and about $\frac{1}{2}$ inch wide.

3. The keyholder of claim 1 wherein the midsection of the strap is secured to the luggage by stitching.

4. The keyholder of claim 1 where said inner face of the luggage is provided by a stiff cover for the luggage and the midsection of the strap is stitched to the inner face of the cover.

5. The keyholder of claim 1 wherein the fasteners are hook and loop fastener pads respectfully secured to the strap and inner face of the luggage.

6. The keyholder of claim 1 wherein the luggage has a rigid cover, the strap is stitched at its midsection to the cover, the cover carries an open top pocket, and the strap is positioned sufficiently close above the open top pocket so that keys depending from the key ring held by the strap extend into the pocket.

7. In combination with luggage having an inner face with an open top pocket thereon, a holder for a key carrying key ring which comprises a strap overlying said inner face flatwise above and substantially parallel with the open top of the pocket, means securing the longitudinal midsection of said strap to said face dividing the strap into oppositely extending wings with free ends, fasteners detachably securing the free ends of said wings to said inner face, said ends of the wings adapted to be pulled free from said fasteners, drawn into juxtaposed position and threaded through a key loaded key ring, and said wings adapted to be spread back to their original flat position with their ends reattached to the inner face of the luggage for holding the key ring flatwise on opposite sides of the fastened midsection with keys from the key ring extending into said top of the pocket whereby said key ring is held flatwise between the strap and inner face of the luggage and the keys are draped flatwise between the pocket and inner face of the luggage.

8. The holder of claim 7 wherein the strap is positioned about 1 to 2 inches above the open top of the pocket adjacent one end of the pocket.

9. The holder of claim 7 wherein the fasteners are hook and loop pads respectfully secured to the ends of the strap and the inner face of the luggage.

10. A key and key ring holder for briefcases having covers with rigid inner faces and at least one open top pocket on the inner face of the cover which comprises a longitudinally extending strap secured at its midsection to said inner face of the cover above the open top of the pocket, hook and loop fastener pads on the inner faces of the outer ends of the strap, complimentary hook and loop fastener pads on the inner face of the cover positioned to mate with and hold the strap in extended condition flatwise on the inner face of the cover, said pad carrying ends of the strap adapted to be pulled from the pads on the inner face of the cover and threaded through a key ring to straddle the ring on opposite sides of the secured midsection of the strap, and said pad ends of the strap adapted to be relocked with the pads on the inner face of the cover to press the key ring flatwise against said inner face with the keys thereon depending into the open top of the pocket.

11. The holder of claim 10 wherein the pads are cylindrical.

* * * * *